US011525327B2

(12) United States Patent
Gorrara et al.

(10) Patent No.: US 11,525,327 B2
(45) Date of Patent: Dec. 13, 2022

(54) MORPHABLE APPARATUS

(71) Applicant: SCHLUMBERGER TECHNOLOGY CORPORATION, Sugar Land, TX (US)

(72) Inventors: Andrew John Joseph Gorrara, Aberdeen (GB); Kevin Stewart, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 568 days.

(21) Appl. No.: 14/718,287

(22) Filed: May 21, 2015

(65) Prior Publication Data

US 2015/0345249 A1 Dec. 3, 2015

(30) Foreign Application Priority Data

May 29, 2014 (GB) ..... 1409525.1

(51) Int. Cl.
*E21B 33/127* (2006.01)
*E21B 33/129* (2006.01)
(Continued)

(52) U.S. Cl.
CPC ..... *E21B 33/127* (2013.01); *E21B 23/01* (2013.01); *E21B 23/04* (2013.01); *E21B 23/06* (2013.01);
(Continued)

(58) Field of Classification Search
CPC ..... E21B 23/04; E21B 33/127; E21B 23/06; E21B 33/1295
(Continued)

(56) References Cited

U.S. PATENT DOCUMENTS 6,640,893 B1 11/2003 Rummel et al.
2002/0014339 A1 2/2002 Ross
(Continued)

FOREIGN PATENT DOCUMENTS

EP 2013445 A1 10/2007
EP 2565365 A1 3/2013
(Continued)

OTHER PUBLICATIONS

EPO as International Search Authority, International Search Report for PCT/GB2015/051533, dated Jan. 4, 2016, entire document.
(Continued)

*Primary Examiner* — Taras P Bemko
(74) *Attorney, Agent, or Firm* — Matthew Goode

(57) ABSTRACT

Apparatus and method for securing and sealing a tubular portion to another tubular to provide a liner hanger in oil and gas wells. At the top of the liner string, a sleeve is arranged on the liner to create a chamber therebetween. A port provides fluid access through the liner to the chamber. When fluid is introduced into the chamber the sleeve is morphed to secure it to the cemented casing. A lower fluid pressure is required to morph the sleeve than if the liner itself was to be morphed. Embodiments are provided for securing and sealing arrangements to increase the metal to metal seal and the load capability between the liner string and casing.

17 Claims, 1 Drawing Sheet

(51) Int. Cl.

| | |
|---|---|
| ***E21B 23/06*** | (2006.01) |
| ***E21B 34/06*** | (2006.01) |
| ***E21B 23/01*** | (2006.01) |
| ***E21B 43/10*** | (2006.01) |
| ***E21B 23/04*** | (2006.01) |
| ***E21B 33/1295*** | (2006.01) |

(52) U.S. Cl.
CPC ..... *E21B 33/1292* (2013.01); *E21B 33/1295* (2013.01); *E21B 34/063* (2013.01); *E21B 43/103* (2013.01)

(58) Field of Classification Search
USPC ..... 166/387
See application file for complete search history.

(56) References Cited

U.S. PATENT DOCUMENTS

| | | | | |
|---|---|---|---|---|
| 2005/0161232 | A1 | 7/2005 | Patel et al. | |
| 2006/0027371 | A1 | 2/2006 | Gorrara | |
| 2015/0315864 | A1* | 11/2015 | Patton | E21B 43/103 166/382 |
| 2015/0337617 | A1* | 11/2015 | McBride | E21B 33/126 166/387 |

FOREIGN PATENT DOCUMENTS

| | | | | |
|---|---|---|---|---|
| EP | 2586963 | A1 | 5/2013 | |
| EP | 2599955 | A1 | 6/2013 | |
| EP | 2607614 | A1 | 6/2013 | |
| WO | WO 2010/136806 | A2 | 12/2010 | |
| WO | WO 2011048426 | A2 * | 4/2011 | E21B 43/108 |
| WO | WO2012/127229 | A2 | 9/2012 | |

OTHER PUBLICATIONS

GB Intellectual Property Office, Search Report for GB1409525.1, dated Dec. 17, 2014, see attached.

Examination Report for corresponding GCC Application Serial No. GC 2015-29468, dated Feb. 22, 2018, 3 pages.

Second Examination Report for corresponding GCC Application Serial No. GC 2015-29468, dated Jul. 4, 2018, 3 pages.

Search Report for corresponding GB Application Serial No. GB 1409525.1, dated Dec. 18, 2014, 6 pages.

International Search Report and Written Opinion for corresponding PCT Application Serial No. PCT/GB2015/051533, dated Dec. 16, 2015, 10 pages.

* cited by examiner

MORPHABLE APPARATUS

The present invention relates to an apparatus and a method for securing and sealing a tubular portion to another tubular. The apparatus and method are particularly suited for use in oil and gas wells. More particularly, the apparatus can be used as a liner hanger assembly.

Oil and gas wells are conventionally drilled using a drill string to create a subterranean borehole. After drilling, the borehole is usually completed by running in a casing/liner string that is typically cemented in place. Additional liner strings may be required to be installed or coupled to the initially installed casing string in order to extend the reach of the completed borehole. This is conventionally achieved using liner hangers to couple additional liner strings to the lower end of the existing casing or liner string in the borehole. The liner hangers typically use mechanically or hydraulically set slips to bite into the existing casing. Furthermore, a packer is usually also used to provide a fluid tight seal at the location of the liner hanger to prevent fluid, in particular, gas ingress.

Conventional liner hangers can have problems, particularly when setting in "worn" casing which may have a non-uniform internal surface as it can be difficult to achieve the required quality of seal with such conventional liner hangers because they may not be able to expand compliantly against such an internal surface.

The present applicants have developed a technology which overcomes this difficulty. A tubular, such as a liner, is forced radially outwardly by the use of hydraulic fluid pressure acting directly on the inner surface of the tubular. Sufficient hydraulic fluid pressure is applied to move the tubular radially outwards and cause the tubular to morph itself onto a generally cylindrical structure in which it is located, such as previously installed, existing tubular, such as cemented casing string or cemented liner string to act as a liner hanger. The morphed tubular undergoes plastic deformation and, the metal existing tubular will undergo elastic deformation to expand by a small percentage as contact is made. When the pressure is released the existing tubular returns to its original dimensions and will create a seal against the plastically deformed liner. During the morphing process, the inner surface of the liner will take up the shape of the surface of the wall of the existing tubular. This morphed liner hanger is therefore ideally suited for creating a seal against an irregular or worn casing/liner string. A description of liner hangers based on this principle is disclosed in EP2013445 and WO 2012/127229, both to the present applicants and incorporated herein by reference.

Liners used in the oil and gas industry come in standard diameters, thicknesses and materials. As they are designed to withstand formation pressures, the material and thickness is not ideally suited to be morphed and as such, high fluid pressures are required to achieve the morphed metal to metal seal. While varying materials and thicknesses has been proposed these potentially compromise the strength and ruggedness of the liner hanger assembly.

It is an object of the present invention to provide further alternative morphable tubular apparatus for securing and sealing to another tubular.

According to an aspect of the present invention, there is provided a tubular portion apparatus to be secured and sealed to an existing tubular in a wellbore, the tubular portion comprising:

- a base pipe to be run into and sealed against the existing tubular,
- the base pipe having an upper end and a lower end;

the base pipe being characterised in that:

- at the upper end of the base pipe there is a sleeve member positioned around an exterior of the base pipe;
- first and second connectors are arranged at each end of the sleeve member to seal the sleeve member to the exterior of the base pipe and create a chamber therebetween;
- a port having a valve to permit the flow of fluid into the chamber is provided through the base pipe in order to increase pressure within the chamber to cause the sleeve member to move outwardly and morph against an inner surface of the existing tubular.

In this way, the base pipe can be formed of any chosen material as it does not require to be morphed while the sleeve can be selected from a material which is easily morphed. By this selection, a lower fluid pressure than in the prior art can advantageously be used to morph the assembly.

Preferably, the base pipe is a liner and the existing tubular is selected from a group comprising: a casing string, a liner string, a cemented casing string and a cemented liner string.

In this way, the base pipe can be used at an end of the existing tubular to provide an extension to the existing tubular and therefore act as a liner hanger.

The sleeve member may have a first end which is affixed and sealed to the base pipe and a second end which includes a sliding seal to permit longitudinal movement of the second end over the base pipe. In this way, as the sleeve is morphed, longitudinal contraction of the sleeve member occurs which reduces the thinning of the sleeve member during morphing.

Preferably, there is a plurality of ports arranged through the pipe. In this way, rapid morphing of the sleeve member can be achieved. The ports may be arranged circumferentially around the base pipe. The ports may be arranged longitudinally along the base pipe.

The port may include a barrier. In this way, fluid is prevented from entering the chamber until activation is required. The barrier may be a rupture disc which allows fluid to flow through the port at a predetermined fluid pressure. Alternatively the barrier may be a valve. Preferably the valve is a one-way check valve. In this way, fluid is prevented from exiting the chamber. More preferably the valve is set to close when the pressure in the chamber reaches a morphed pressure value.

A barrier may be located through the sleeve member. In this way, fluid may be directed into or out of the sleeve member. Preferably, the barrier is a rupture disc. In this way, if expansion pressure exceeds the value of the rupture disc, it will burst allowing communication between an annulus below the sleeve member and the chamber.

Alternatively or additionally, securing and sealing means can be provided on an outer surface of the sleeve member. The securing and sealing means could in certain embodiments be provided simply by the outer surface of the sleeve member. However, the securing and sealing means can preferably comprise a roughened part of the outer surface of the sleeve member to enhance the grip of the sleeve member on the existing tubular. At least part of an outer surface of the sleeve member can be coated with an elastomeric material to aid sealing. The securing or sealing means can comprise a profile applied to an outer surface of the sleeve member.

Additional elastomeric material preferably in the form of one or more elastomeric band(s) can be positioned along the length of the sleeve member incorporating a fluid exclusion path that will ensure that fluid is not trapped by the elastomer band(s). The higher coefficient of friction of the elastomer material of the one or more band(s) in contact with the metal will cause the load carrying capacity of the apparatus to be increased.

Optionally, the tubular portion apparatus includes an anchoring system, the anchoring system being used to increase the load bearing capacity of the apparatus following morphing.

Preferably, the sleeve member has an anchoring system arranged around a circumference thereof; the anchoring system comprising: a gripper element having first and second oppositely arranged inclined surfaces; first and second wedge elements having third and fourth inclined surfaces respectively arranged on either side of the gripper element; wherein at least one of the wedge elements is a beam spring and the anchoring system is configured to maintain the gripper element in a radially extended position by action of the at least one beam spring following morphing of the sleeve member.

Such an anchoring system is described in applicant's co-pending application GB 1407746.5, incorporated herein by reference.

Alternatively or additionally, the anchoring system is arranged on a connector. The anchoring system may include one or more slips as are known in the art.

According to a second aspect of the present invention, there is provided a method of securing and sealing a tubular portion apparatus to an existing tubular in a wellbore, the method comprising the steps of:

(a) providing a tubular portion according to the first aspect;
(b) running the tubular portion into a wellbore on a string and positioning the sleeve member at a desired location within the existing tubular;
(c) pumping fluid through the tubular portion and through a port in the base pipe to access the chamber;
(d) causing the sleeve member to move radially outwardly and morph against an inner surface of the existing tubular to thereby secure and seal the tubular portion apparatus to the existing tubular.

In this way, the tubular portion apparatus provides a liner hanger. The tubular portion apparatus would typically be installed at the upper end of a liner string. The liner is typically deployed into the well initially inside of a casing string and then possibly into open bore hole. The liner hanger is typically always inside the casing. The liner may then be cemented in place, and the sleeve member would be hydraulically expanded into the casing. Once set, the liner hanger provides a pressure seal and bi-directional load bearing capability.

The method can include running an expansion tool into the tubular portion and engaging an inner diameter of the base pipe and the expanding sleeve member by using the expansion tool. Preferably, the method includes the step of pumping fluid through the expansion tool and in a first configuration, allowing fluid flow directly through the tool: and, in a second configuration, diverting fluid flow through the valve into the chamber of the tubular portion.

In this way, the liner string can be run in on the expansion tool and circulating and cementing can be achieved through the expansion tool while the circulating fluid can also be used to morph the sleeve member.

The method may further include the step of mounting a liner tieback system on the tubular portion apparatus. Such a liner tieback system may be as disclosed in WO 2011/048426, which is incorporated herein by reference.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

An embodiment of the present invention will now be described, by way of example only, with reference to the accompanying drawings of which:

Figure 1:
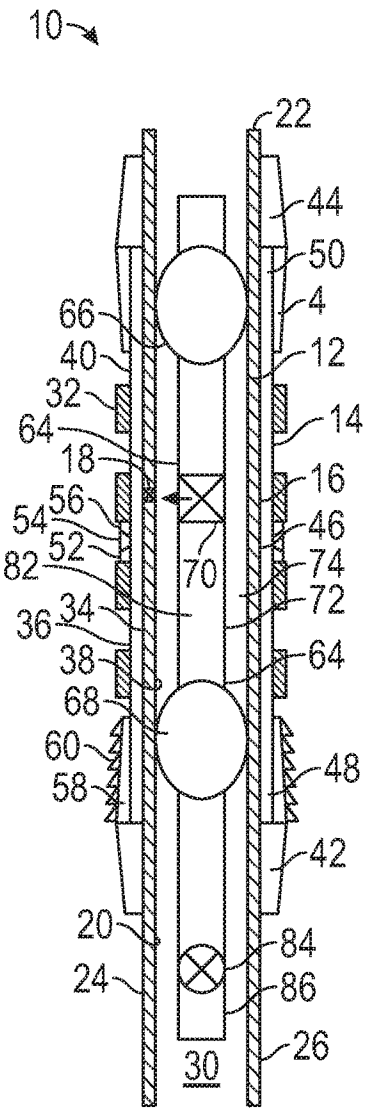
FIG. 1 is a cross-sectional view through a tubing portion apparatus according to an embodiment of the present invention.

Reference is initially made to FIG. 1 of the drawings which illustrates a tubing portion apparatus, generally indicated by reference numeral 10, including a base pipe 12, sleeve member 14, chamber 16, and port 18 according to an embodiment of the present invention.

Base pipe 12 is a cylindrical tubular section having at a first end 22, the sleeve member 14, distal from the opposing end 26. Pipe 12 is standard liner as is known in the art. The liner has a standard inner diameter and outer diameter and is formed of a high grade steel. Pipe 12 may form the uppermost part of a liner string. Pipe 12 includes a throughbore 30.

A port 18 is provided through the side wall 34 of the pipe 12 to provide a fluid passageway between the throughbore 30 and the outer surface 36 of the pipe 12. While only a single port 18 is shown, it will be appreciated that a set of ports may be provided. These ports may be equidistantly spaced around the circumference of the pipe 12 and/or be arranged along the pipe between the first end 22 and the second end 26 to access the chamber 16.

In an embodiment, at the port 18 there is located a check valve 54. The check valve 54 is a one-way valve which only permits fluid to pass from the throughbore 30 into the chamber 16. The check valve 54 can be made to close when the pressure within the chamber 16 reaches a predetermined level, this being defined as the morphed pressure value. Thus, when the pressure in the sleeve 14 reaches the morphed pressure value, the valve 54 will close. Also arranged at the port 18 is a rupture disc 56. The rupture disc 56 is rated to a desired pressure at which fluid access to the chamber is desired. In this way, the rupture disc 56 can be used to control when the setting of the sleeve 14 is to begin. The disc 56 can be operated by increasing pressure in the throughbore 30 with the pressure to rupture the disc being selected to be greater than the fluid pressure required to activate any other tools or functions in the well bore.

Base pipe 12 is located coaxially within a sleeve member 14. Sleeve member 14 is a steel cylinder being formed from typically 316L or Alloy 28 grade steel but could be any other suitable grade of steel or any other metal material or any other suitable material which undergoes elastic and plastic deformation. Ideally the material exhibits high ductility i.e. high strain before failure. The sleeve member 14 is appreciably thin-walled of lower gauge than the base pipe 12 and is preferably formed from a softer and/or more ductile material than that used for the base pipe 12. The sleeve member 14 may be provided with a non-uniform outer surface 40 such as ribbed, grooved or other keyed surface in order to increase the effectiveness of the seal created by the sleeve member 14 when secured within an existing tubular.

An elastomer or other deformable material may be bonded to the outer surface 40 of the sleeve 14; this may be as a single coating but is preferably a multiple of bands 32 with gaps therebetween. The bands 32 or coating may have a profile or profiles machined into them. The elastomer bands may be spaced such that when the sleeve 14 is being morphed the bands will contact the inside surface 24 of existing tubular 28 first. The sleeve member 14 will continue to expand outwards into the spaces between the bands, thereby causing a corrugated effect on the sleeve member 14. These corrugations provide a great advantage in that they increase the stiffness of the sleeve member 14, increase its resistance to collapse forces and also improves annular sealing.

Sleeve member 14 which surrounds the base pipe 12 is affixed thereto via welded, crimped, clamped or shrink-fit connections 42, 44, respectively. Such attachments 42, 44 are pressure-tight connectors. An O-ring seal (not shown) may also be provided between the inner surface 46 of the sleeve member 14 and the outer surface 36 of the base pipe 12 to act as a secondary seal or back-up to the seal provided by the welded connections. In an embodiment of the present invention, the first attachment means 42 is provided by a mechanical clamp to fix the first end 48 of sleeve member 14 to the base pipe 12. The second end 50 of the sleeve member 14 is connected to the outer surface 36 of the base pipe 12 via a sliding seal arrangement. In this way, the second end 50 of the sleeve member 14 can move longitudinally along the outer surface 36 of the base pipe 12 while maintaining a seal between the surfaces to hold pressure within the chamber 16. This sliding seal is arranged so that the second end 50 of the sleeve member 14 is permitted to move towards the first end 48. Thus when the sleeve member 14 is caused to move in a radially outward direction, during morphing, the sleeve contracts which causes simultaneous movement of the sliding seal. This has the advantage in reducing thinning of the material of the sleeve 14 by the radial outward expansion.

The attachments 42, 44 together with the inner surface 46 of the sleeve member 14 and the outward surface 36 of the pipe 12 define the chamber 16. The port 18 is arranged to access the chamber 16 and permit fluid communication between the through-bore 30 and the chamber 16. The chamber 16 may be of negligible volume initially or it may be pre-filled with fluid, a settable material or an expandable material. The materials assist in the morphing process.

A first anchoring system 52 may be arranged circumferentially around the outer surface 40 of the sleeve member 14. The anchoring system 52 has a gripper element 55 with oppositely arranged inclined surfaces and wedge elements 57 having inclined surfaces mutually arranged on either side of the gripper element with at least one of the wedge elements being a beam spring. Following morphing of the sleeve member 14 the anchoring system 52 is configured to maintain the gripper element 55 in a radially extended position by action of the at least one beam spring 56 and thereby increase the load bearing capacity of the morphed apparatus 10 in the well. The anchoring system 52 is described in applicant's co-pending application GB 1407746.5, incorporated herein by reference.

A further anchoring system 58 is arranged on the first connector 42, at a location which will be expanded under morphing. Anchoring system 58 is a set of slips as is known in the art.

Thus, the tubular portion apparatus 10 is constructed by taking a base pipe 12 and locating a sleeve member 14 thereon. A first end 48 of the sleeve member 14 is attached to the base pipe via the attachment 42. The sleeve member 14 may be filled with a fluid or material if desired. Once located in the sleeve, the second end 50 of the sleeve member is also attached to the base pipe 12, via attachment 44. Anchoring systems 52, 58 may be fitted to the apparatus 10, before or after the sleeve member 14 is located upon the base pipe 12. The diameter of the sleeve member 14 will have been selected to match the inner diameter of the casing 28 into which the assembly 10 is intended for use.

Apparatus 10 is then ready for deployment into a wellbore 62. For deployment, the apparatus 10 is sealed to an expansion tool 64. The expansion tool 64 is then located on a running tool and a drill pipe or other string to surface. This arrangement can be considered as a liner running system.

Expansion tool 64 includes first and second seal assemblies 66, 68 placed at either end so that they align with seal bores on the inner surface 38 of the base pipe 12. The seal assemblies 66, 68 are designed to maintain seals in excess of 12,000 psi. The separation between the seal assemblies 66, 68 can be varied to suit the size and application, needing only to straddle the port 18 while supporting the apparatus 10. A diverter valve 70 is incorporated into the string 72 of the expansion tool 64 that will allow the fluid pumped from surface to pass either directly through the expansion tool 64 for circulating or cementing, or via a port into an annulus 74 between the outer surface 76 of the expansion tool 64 and the inner surface 38 of the base pipe 12. The diverter valve 70 has multiple resets. An isolation device 84 is located at the lower end 86 of the expansion tool 64.

The liner running system will allow for torque and axial load to be transmitted to the base pipe 12 during a drilling process.

The apparatus 10 is then run into a wellbore 62 on the liner running system and the sleeve member 14 is positioned within a casing 28. The casing 28 may be cemented in position. In this regard the diverter valve 70 allows through passage of cement in the bore 82 of the tool 64. Additionally the isolation device 84 is open to allow cementing through it during run-in.

Figure 2:
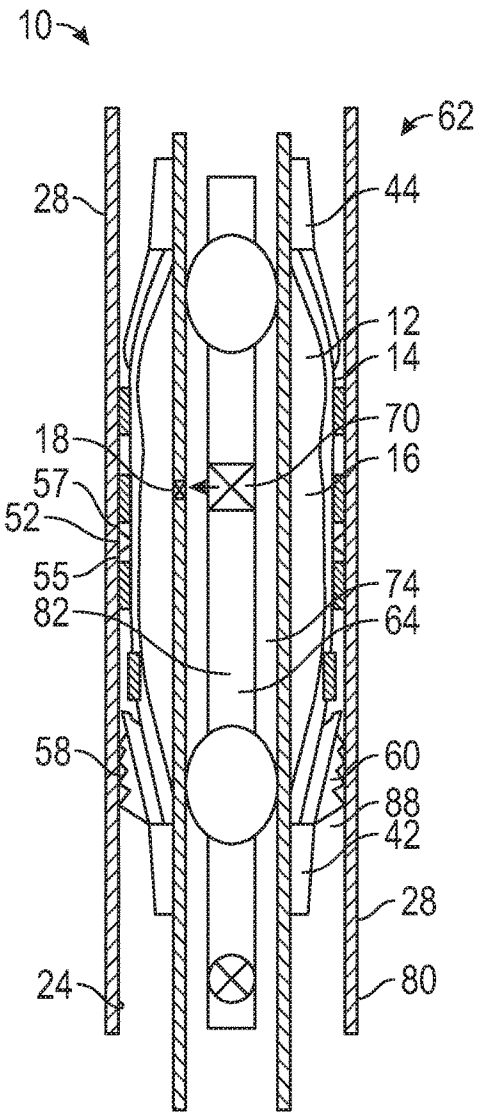
FIG. 2 is a cross-sectional view through the a tubing portion apparatus of FIG. 1 following morphing of the sleeve member.

Referring now to FIG. 2 of the drawings, the sleeve member 14 is located towards a lower end 80 of the casing 28. When in position, the isolation device 84 is closed either by use of a drop ball or a wiper device seating and sealing in a bore in the lower end 86 of the tool 64. Fluid pumped through a bore in tool 64 from surface is now directed by the diverter valve 70 to enter the annulus 74. As this is a sealed area, fluid pressure will increase to a point where the disc 56 ruptures and allows fluid under pressure to pass through the check valve 54 at the port 18. As detailed previously, multiple ports 18 may be located upon the base pipe 12 to increase the rate of fluid pressure entering the chamber 16. As the chamber 16 is cylindrical in nature and the material of the sleeve member 14 is more elastic than that of the base pipe 12, as pressure increases in the chamber 16, the sleeve member 14 will be forced radially outwardly from the base pipe 12 across an annulus 88 between the outer surface 36 of the base pipe 12 and the inner surface 24 of the casing 28. This expansion of the sleeve member 14 by fluid pressure is assisted by any expandable or swellable material, if present, in the chamber 16.

Fluid pressure will continue to enter through port 18 until the sleeve member 14 contacts the inner surface 24 of the casing 28 and effectively morphs the material of the sleeve member 14 against the inner surface 24. This morphing creates a metal-to-metal seal between the sleeve member 14 and the casing 28. This process is known and operates by elastically and then plastically deforming the sleeve member 14. On contact with the casing 28, the casing 28 may also elastically deform under fluid pressure. At a morphed fluid pressure value, the check valve 54 closes therefore sealing the chamber 16. At this pressure value, the sealed chamber and in particular, the sleeve member 14 will wish to relax slightly. This relaxation will cause the elastically deformed casing 28 to also contract back to its original diameter. This movement improves the metal-to-metal seal between the sleeve 14 and the casing 28. The seal between the apparatus 10 and the casing 28 thus forms a barrier in the wellbore 62 so that fluid flow through the annulus 88 is prevented. Indeed, a loss of fluid flow through the annulus 88 can be considered as the point at which an effective barrier seal has been made by the apparatus 10.

In an embodiment, elastomer bands 32 are bonded to the outside surface 40 of the sleeve member 14. The elastomer bands 32 are annular ring shaped and are spaced apart along the longitudinal axis of the sleeve member 14 such that when the sleeve member 14 is expanded, the bands 32 will contact the inside surface 24 of the casing 28 and therefore the portion of the sleeve member 14 immediately behind the band 32 will tend to be prevented from any further expansion. The rest of the sleeve member 14 (i.e. the portions between the bands 32) will continue to expand outwards in the region of the gaps/spaces between the bands 32 causing a corrugated effect on the sleeve member 14. These corrugations have the great advantage that they increase the stiffness of the sleeve member 14 and increase its resistance to collapse forces. Further the elastomer bands 32 may include one or more fluid pathways arranged longitudinally through the band 32. In this way, as the sleeve member 14 is morphed and the bands 32 make contact with the inner surface 24 of the casing 28, fluid in the annulus 88 may be trapped between adjacent bands 32. This fluid could cause hydraulic lock and prevent the metal to metal seal being achieved. With the fluid pathways, the fluid can escape towards each end 48,50 of the sleeve member 14 and allow the outer surface 40 to morph directly against the inner surface 24 of the casing 28 and achieve the metal to metal seal.

During morphing of the sleeve member 14, the anchoring systems 52, 58 will operate. In the first anchoring system 52, during the expansion, the springs 58 and gripper element 55 will also be forced radially outwards. Depending upon the materials chosen for the springs 58 and gripper element 55, these may elastically deform. Alternatively, if the materials do not expand then sufficient pressure will be applied to cause sections of the springs 58 and gripper element 55 to break apart and so provide an opening in each for expansion. As the sleeve member 14 is morphed ridges on the gripper element 55 will bite into the inner surface 24 of the casing 28 as the outer surface 36 will take up a fixed shape under plastic deformation with the surface 36 matching the profile of the inner surface 24 of the casing 28. Morphing will have effectively centered, secured and anchored the assembly 10 to the casing 28. During morphing the sleeve member 14 will have contracted axially and the already pre-loaded beam springs 58 will act axially against the gripping member 55. The wedge action on the inclined surfaces at either side of the gripper element 32 will force the gripper element 55 radially outwards and retain the ridges and gripping action on the outer tubular. Even when the sleeve member 14 relaxes the axially arranged action of the beam springs 58 via the inclined surfaces will give a greater radial movement, to force the gripper element 55 outwards, than the inward radial movement caused by the relaxation of the sleeve member 55. This will ensure contact is maintained to anchor the gripper element 55 to the inner surface 24 of the casing 28.

Additionally, on expansion, the slips 60 of the second anchoring system 58 will also engage with the inner surface 24 of the casing 28 and further anchor the apparatus 10 to the casing 28.

Figure 3:
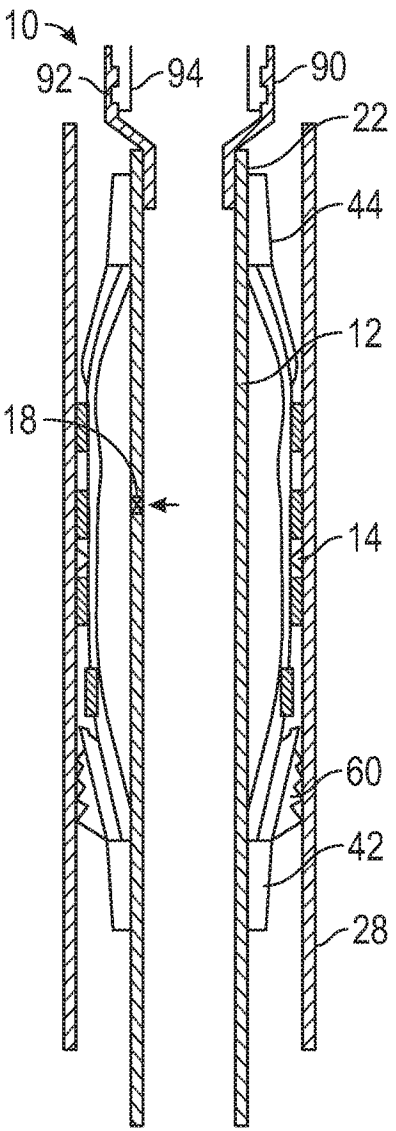
FIG. 3 is a cross-sectional view through the a tubing portion apparatus of FIG. 1 illustrating a liner hanger with tie back connector according to a further embodiment of the present invention.

Once the apparatus 10 has been secured to the casing 28, the annular seals 66,68 are de-activated and are therefore retracted and thus, the expansion tool 64 can be pulled out of the wellbore leaving a liner hanger as shown in FIG. 3.

In many well completion schemes it may be necessary to connect the liner string 12 back to the surface (or a point higher up in the well). With the arrangement shown in FIG. 3, a string of tubing can be connected to the top 22 of the liner section 12. In this manner, the casing 28 is sealingly "tied back" to the surface (or a point higher in the well). Known methods for connecting a string of tubing into a downhole liner section typically involve the use of a tool known as a polished bore receptacle (PBR). Here we prefer to use a technique disclosed in WO 2011/048426 which advantageously uses the morphing principle. A swage overshot device 90 is provided at the upper end 22 of the base pipe 12 such that it has a greater diameter than the diameter of the base pipe 12. The overshot device 90 includes a number of internal recesses 92 at its internal bore. The overshot device may be attached to the casing 90 as desired. A second liner string 94 is lowered so that its lower end is within the overshot device 90 and lower than the internal recesses 32 of the overshot device 30. An expandable tool is then run on the lower end of a string of drillpipe down through the bore of the second liner string 94 until the tool is aligned with the recesses 92 of the overshot device 90. The tool 40 includes a depth latch arrangement for positioning at the correct vertical depth. The tool includes a pair of seals which are vertically spaced apart by a distance greater than the vertical distance between the upper and lower recesses. The second liner string 94 is then morphed into the recesses 92 and an effective liner tieback connection has been made to surface.

The principle advantage of the present invention is that it provides an apparatus for creating a liner hanger in which the pressure required to achieve the metal to metal seal and anchor the liner hanger is lower than the prior art arrangements.

A further advantage of the present invention is that it provides an apparatus for creating a liner hanger in which a standard liner can be used so that it does not compromise strength or torque capabilities.

It will be apparent to those skilled in the art that modifications may be made to the invention herein described without departing from the scope thereof. For example, a separate anchoring system could be located on the liner string below the sleeve member to anchor the hanger apparatus in place. Fluid pressure in the chamber may be increased by directly pumping fluid from the surface or the expansion tool may incorporate a pressure intensifier.

The invention claimed is:

1. A tubular portion apparatus to be secured and sealed to an existing tubular in a wellbore, the tubular portion apparatus comprising:

a base pipe to be run into and sealed against the existing tubular, the base pipe having an upper end and a lower end, wherein at the upper end of the base pipe, there is a sleeve member positioned around an exterior of the base pipe, wherein first and second connectors are arranged at each end of the sleeve member to seal the sleeve member to the exterior of the base pipe and create a chamber therebetween;

wherein a port having a barrier permits the flow of fluid into the chamber through the base pipe in order to increase pressure within the chamber to cause the sleeve member to move outwardly and morph against an inner surface of the existing tubular, wherein the tubular portion apparatus further comprises an anchoring system having elements disposed at an end of said sleeve member, the anchoring system being used to increase the axial load bearing capacity of the apparatus following morphing, wherein securing and sealing means are provided on an outer surface of the sleeve member, and wherein one or more elastomeric band(s) are positioned along the length of the sleeve member incorporating a longitudinal fluid exclusion path therethrough that allows fluid to escape towards each end of the sleeve member, ensuring that fluid is not, which prevents hydraulic lock and achieves a metal to metal seal.

2. The tubular portion apparatus according to claim 1, wherein the base pipe is a liner and the existing tubular is selected from a group comprising: a casing string, a liner string, a cemented casing string and a cemented liner string.

3. The tubular portion apparatus according to claim 2, wherein the base pipe is used at an end of the existing tubular to provide an extension to the existing tubing and therefore act as a liner hanger.

4. The tubular portion apparatus according to claim 1, wherein the sleeve member has a first end which is affixed and sealed to the base pipe and a second end which includes a sliding seal to permit longitudinal movement of the second end over the base pipe.

5. The tubular portion apparatus according to claim 1, wherein the barrier is a rupture disc, which allows fluid to flow through the port at a predetermined fluid pressure.

6. The tubular portion apparatus according to claim 1, wherein the barrier is a valve.

7. The tubular portion apparatus according to claim 1, further comprising a rupture disc located through the sleeve member.

8. The tubular portion apparatus according to claim 1, wherein an outer surface of the sleeve member comprises a roughened part to enhance the grip of the sleeve member on the existing tubular.

9. The tubular portion apparatus according to claim 1, wherein at least part of an outer surface of the sleeve member is coated with an elastomeric material to aid sealing.

10. The tubular portion apparatus according to claim 1, wherein the securing or sealing means comprise a profile applied to an outer surface of the sleeve member.

11. The tubular portion apparatus according to claim 1, wherein the sleeve member has the anchoring system arranged around a circumference thereof; the anchoring system comprising: a gripper element having first and second oppositely arranged inclined surfaces; first and second wedge elements having third and fourth inclined surfaces respectively arranged on either side of the gripper element; wherein at least one of the wedge elements is a beam spring and the anchoring system is configured to maintain the gripper element in a radially extended position by action of the at least one beam spring following morphing of the sleeve member.

12. The tubular portion apparatus according to claim 11, wherein the anchoring system is arranged on one of said first and second connectors.

13. The tubular portion apparatus according to claim 12, wherein the anchoring system includes one or more slips.

14. A method of securing and sealing a tubular portion apparatus to an existing tubular in a wellbore, the method comprising the steps of:

(a) providing a tubular portion comprising: a base pipe to be run into and sealed against the existing tubular, the base pipe having an upper end and a lower end and being characterised in that: at the upper end of the base pipe there is a sleeve member positioned around an exterior of the base pipe; first and second connectors are arranged at each end of the sleeve member to seal the sleeve member to the exterior of the base pipe and create a chamber therebetween, and wherein the tubular portion further comprises an anchoring system disposed at an end of the sleeve member, the anchoring system being used to increase the axial load bearing capacity of the apparatus following morphing;

(b) running the tubular portion into a wellbore on a string and positioning the sleeve member at a desired location within the existing tubular;

(c) pumping fluid through the tubular portion and through a port in the base pipe to access the chamber; and (d) causing the sleeve member to move radially outwardly and morph against an inner surface of the existing casing to thereby secure and seal the tubular portion apparatus to the existing tubular, wherein one or more elastomeric band(s) are positioned along the length of the sleeve member incorporating a longitudinal fluid exclusion path therethrough that allows fluid to escape towards each end of the sleeve member, ensuring that fluid is not, which prevents hydraulic lock and achieves a metal to metal seal.

15. The method according to claim 14, wherein the method includes running an expansion tool into the tubular portion and engaging an inner diameter of the base pipe and expanding the sleeve member by using the expansion tool.

16. The method according to claim 15, wherein the method includes the steps of pumping fluid through the expansion tool; and diverting fluid flow through the valve into the chamber of the tubular portion.

17. The method according to claim 14, wherein the method further includes the step of mounting a liner tieback system on the tubular portion apparatus.

* * * * *